United States Patent [19]

Obayashi et al.

[11] 4,023,454

[45] May 17, 1977

[54] TONE SOURCE APPARATUS FOR AN ELECTRONIC MUSICAL INSTRUMENT

[75] Inventors: Nobuharu Obayashi; Hikaru Hashizume; Noriji Sakashita; Seiji Kameyama; Sadaaki Ezawa; Toshio Kugisawa; Yutaka Washiyama; Tatsunori Kondo; Hironori Watanabe, all of Hamamatsu, Japan

[73] Assignee: Kabushiki Kaisha Dawai Gakki Seisakusho, Hamamatsu, Japan

[22] Filed: Aug. 28, 1975

[21] Appl. No.: 608,535

[52] U.S. Cl. ..... 84/1.01; 84/1.26

[51] Int. Cl.[2] ..... G10H 1/00

[58] Field of Search ..... 84/1.01, 1.03, 1.26, 84/1.17; 340/172.5

[56] References Cited

UNITED STATES PATENTS

| | | | |
|---|---|---|---|
| 3,515,792 | 6/1970 | Deutsch | 84/1.03 |
| 3,610,806 | 10/1971 | Deutsch | 84/1.26 |
| 3,809,786 | 10/1974 | Deutsch | 84/1.01 |

*Primary Examiner*—Ulysses Weldon

[57] ABSTRACT

A tone source apparatus is provided for an electronic musical instrument. It comprises a memory circuit which has a plurality of addresses and is so arranged that where at least one cycle of a musical tone waveform is divided into p units and a waveform in each section range is represented by a formula containing the abscissa as its variable, a coefficient and a section range quantum number of each formula is memorized in the form of digital signals in the corresponding address. Also included are a clock pulse oscillator, a counter means for counting output clock pulses of the clock pulse oscillator, and a coincidence circuit serving to generate the coincidence signal when the output digital signal of the counter means and a digital signal of the section range quantum number memorized in the memory circuit coincide with one another. A decoder designates the next stage address in order by output signals of the coincidence circuit. A calculation circuit is used for calculating a digital signal from the counter means and a coefficient digital signal from the designated address. A D-A convertor converts the output digital signal of the calculation circuit into a corresponding analog signal. The addresses in the memory circuit have memory portions which memorize as digital signals respective coefficients of n degree multiple term formulae for respective section ranges, and respective section range quantum numbers.

6 Claims, 8 Drawing Figures

TONE SOURCE APPARATUS FOR AN ELECTRONIC MUSICAL INSTRUMENT

FIELD OF THE INVENTION

This invention relates to a tone-source apparatus for an electronic musical instrument.

BACKGROUND

It has been hitherto usual with the kind of electronic musical instrument with which the invention is concerned that musical-tone waveform forming is effected by a plurality of oscillators generating rectangular waves, saw-toothed waves or the like corresponding to respective musical-scale frequencies without output signals obtained from these oscillators being properly combined one with another or passed through filters.

However, this type of apparatus has a limit with respect to producing natural-musical-instrument tones having complicated waveforms. This problem has been satisfied only with musical-tone waveforms approaching to some extent the desired natural-musical-instrument tones.

SUMMARY OF THE INVENTION

This invention has as an object the provision of an apparatus whereby any complicated musical-tone waveforms can be easily produced.

The invention is characterized in the provision of an apparatus which comprises a memory circuit which has a plurality of addresses and is so arranged that, where at least one cycle of a musical-tone waveform is divided into p sections and the waveform in each secton range is represented by a formula using the abscissa as its variable, a coefficient and a section range quantum number for each formula memorized in the form of digital signals in the corresponding address. Also included are a clock-pulse oscillator, a counter means for counting output clock pulses generated by the clock pulse oscillator, a coincidence circuit serving to generate a coincidence signal when an output digital signal of the counter means and a digital signal of the section-range quantum number memorized in the memory circuit coincide with one another, a decoder means serving to designate the next stage address in order in response to output signals of the coincidence circuit, a calculation circuit for calculating digital signal from the counter means and a coefficient digital signal from the designated address, and a D-A convertor means for converting an output digital signal of the calculation circuit into a corresponding analog signal.

BRIEF DESCRIPTION OF THE DRAWING

Embodiments of the invention will next be explained with reference to the accompanying drawings in which.

DETAILED DESCRIPTION

Figure 1:
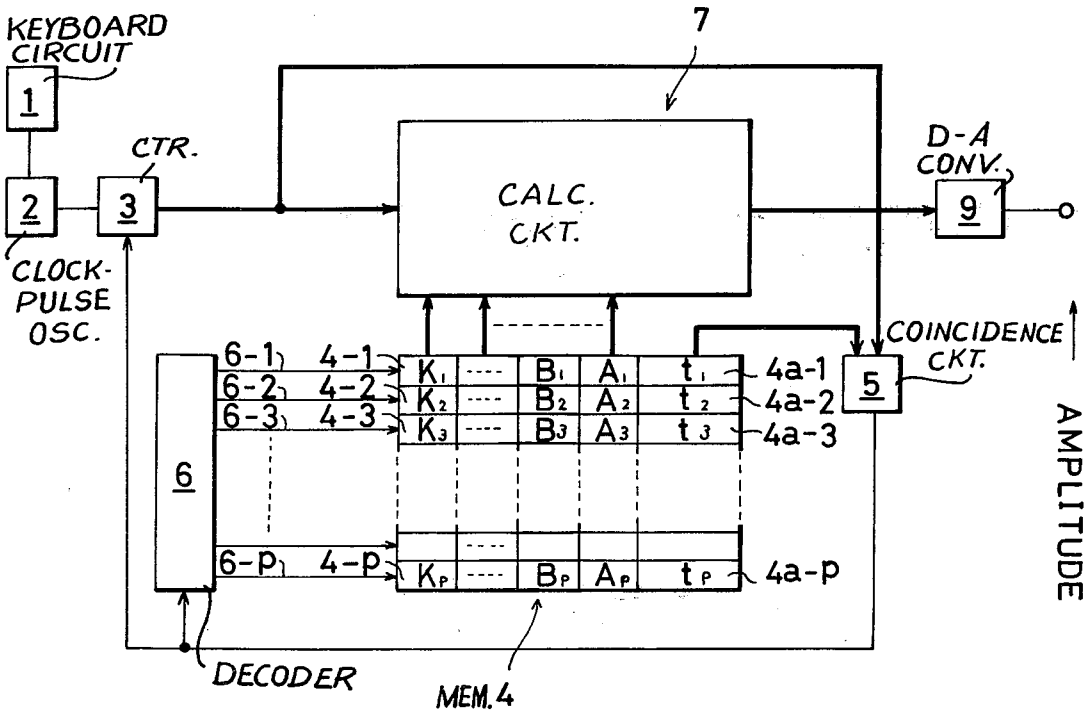
FIG. 1 is a block diagram of a circuit employing a principle of the invention.

In FIG. 1, component 1 is a keyboard circuit which generates a driving signal when a key is depressed, and component 2 is a clock-pulse oscillator which is driven by the driving signal and generates a clock-pulse signal of a frequency which is N times that of a musical tone corresponding to the depressed key.

Component 3 is a counter device which counts clock pulses of the clock-pulse oscillator 2 and comprises a plurality of flip-flop circuits having a respective plurality of output terminals. Component 4 is a memory circuit having a plurality of addressed 4-1, 4-2 . . . 4-p and a plurality of section-range memory portions **4*a*-1, 4*a*-2 . . . 4*a*-p**. This will be explained in greater detail hereinafter.

Component 5 is a coincidence circuit which generates a signal each time an output signal of the counter device 3 and an output signal of the section-range memory portions **4*a*-1, 4*a*-2 . . . 4*a*-p** coincide with each other. An output terminal of coincidence circuit 5 is connected to a reset terminal of the counter device 3 and to a decoder 6.

The decoder 6 comprises, for instance, a ring counter or the like and so arranged that, from respective output signals from the coincidence circuit 5, output signals can be obtained in order from its plurality of output terminals 6-1, 6-2 . . . 6-p for making a selection of respective addresses 4-1, 4-2 . . . 4-p and respective section-range memory portions 4a-1, 4a-2 . . . 4a-p of the memory circuit 4.

Component 7 is a calculation circuit for calculating an output signal for the counter device 3 and an output signal from the memory circuit 4, as will be explained in detail hereinafter. An output terminal of calculating circuit 7 is connected through a D-A converter 9 to an acoustic convertor. For convenience, digital-signal output lines are indicated by heavy lines in this figure as well as the remainder of figures of the drawing.

Figure 3:
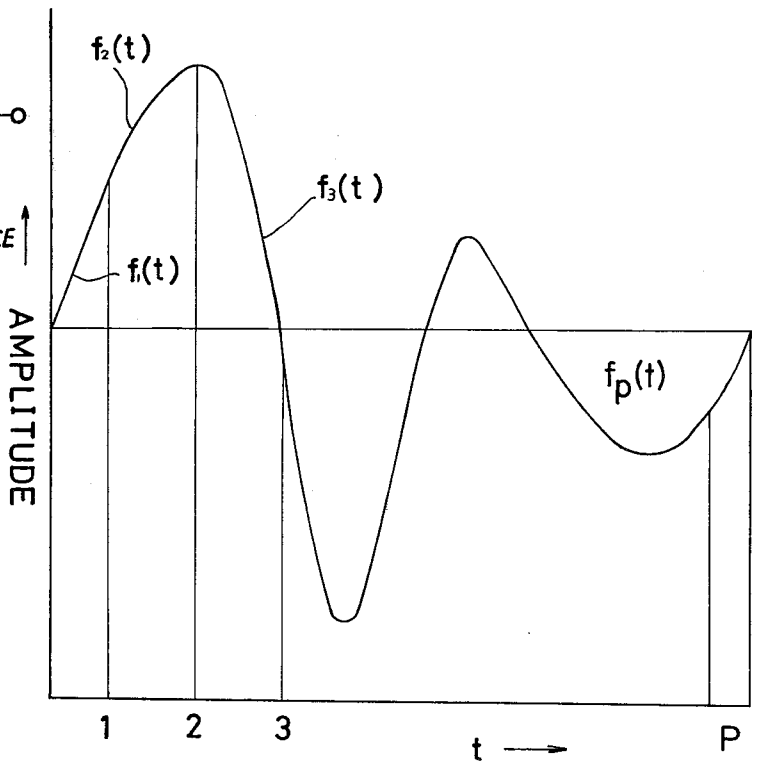
FIG. 3 is a chart showing an example of a musical tone waveform.

If one cycle of a musical tone waveform shown in FIG. 3 is divided into units 1, 2 . . . p along its abscissa (time axis), and these divided waveforms $f_1(t), f_2(t) \ldots f_p(t)$ are expressed by respective multiple-term formulae of $n$ degrees in relation to time $t$, the following formulae (I) can be established.

$$\left.\begin{aligned} f_1(t) &= a_1t^n + b_1t^{n-1} + c_1t^{n-2} + \ldots + K_1 \\ f_2(t) &= a_2t^n + b_2t^{n-1} + c_2t^{n-2} + \ldots + K_2 \\ f_3(t) &= a_3t^n + b_3t^{n-1} + c_3t^{n-2} + \ldots + K_3 \\ f_p(t) &= a_pt^n + b_pt^{n-1} + c_pt^{n-2} + \ldots + K_p \end{aligned}\right\} \quad (I)$$

Herein, $a_1, a_2 \ldots a_p, b_1, b_2 \ldots b_p, c_1, c_2 \ldots\ldots c_p$ represent coefficients and $K_1, K_2 \ldots K_p$ represent constants.

The respective addresses 4-1, 4-2 . . . 4-p of the memory circuit 4 are provided with a plurality of set portions $A_1, B_1 \ldots K_1, A_2, B_2 \ldots K_2, A_p, B_p \ldots K_p$, and these coefficients and constants are memorized as digital signals. At the same time, in the respective section memory portions **4*a*-1, 4*a*-2 . . . 4*a*-p**, quantum numbers $t_1, t_2, \ldots t_p$ of respective times $t$ required for depicting the foregoing respective waveforms $f_1(t), f_2(t)$ . . . $f_p(t)$ are memorized as corresponding digital signals.

The calculation circuit 7 comprises a plurality of accumulatively multiplying devices 7-2 . . 7-p (FIG. 2) which accumulatively multiply, in order, digital signals taken out from the output terminal of the counter device 3, a plurality of mutually multiplying devices 7a-1, . . . 7a-p which multiply the output signal of the counter device 3, respective output signals of the devices 7-2 . . . 7-p and respective coefficents of the memory circuit 4, and an adding device 8 which adds output signals of these mutually multiplying devices 7a-1, 7a-2 . . . 7a-p and constant output signals. Thus, digital signals taken out in order as 1, 2, 3, 4 . . . from the counter device 3 by counting of clock pulses may be accumulatively multiplied in order by the accumulatively multiplying devices 7-2 . . . 7-p, and output signals thereof are then multiplied by respective coefficients at the mutually multiplying devices 7a-1, . . . 7a-p, and output signals thereof and constant output signals are added together at the adding device 8. Thereby, there is effected such a calculation that the respective functions of the foregoing waveform formulae $f_1(t)$, . . . $f_p(t)$ are substituted, in order, by values, and outputs thereof are converted by the D-A converter 9 into waveform signals of the respective formulae.

For the accumulatively multiplying devices 7-2 . . . 7-p, conventional digital multiplying devices 7'. . . 7-p, conventional digital multiplying devices are used. For the mutually multiplying devices 7a-1, 7a-2 . . . 7a-p, however, complement multiplying devices are used so that multiplying may be effected with discrimination of ± of the coefficients, for instance. Alternatively, complement circuits may be provided not in the mutually multiplying devices 7a-1 . . . 7p-1 but on the side of the adding device 8.

Next, an embodiment of the invention will be explained with reference to FIG. 4.

Figures 2, 5:
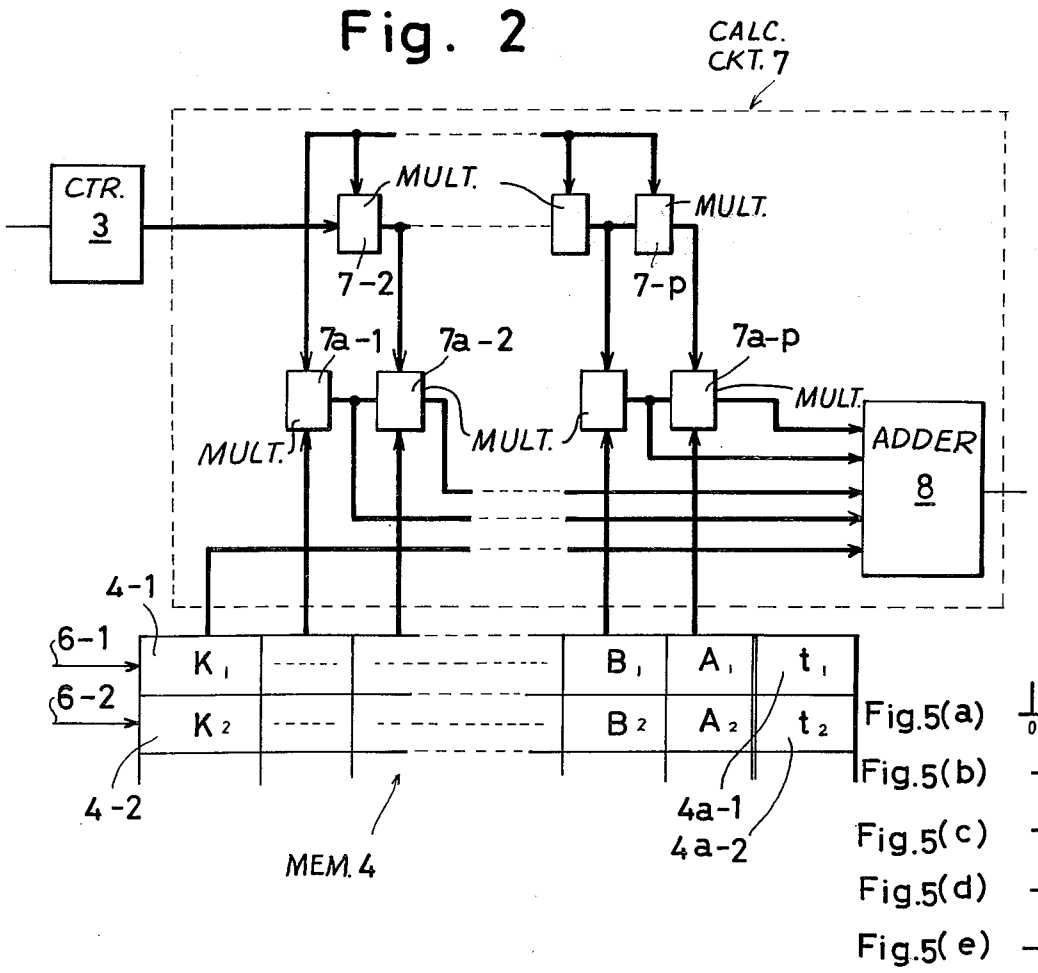
FIG. 2 is a block diagram showing a portion of the circuit of FIG. 1 in detail.
FIG. 5 is a chart showing output waveforms at a portion of the circuit of FIG. 4.
Figure 4:
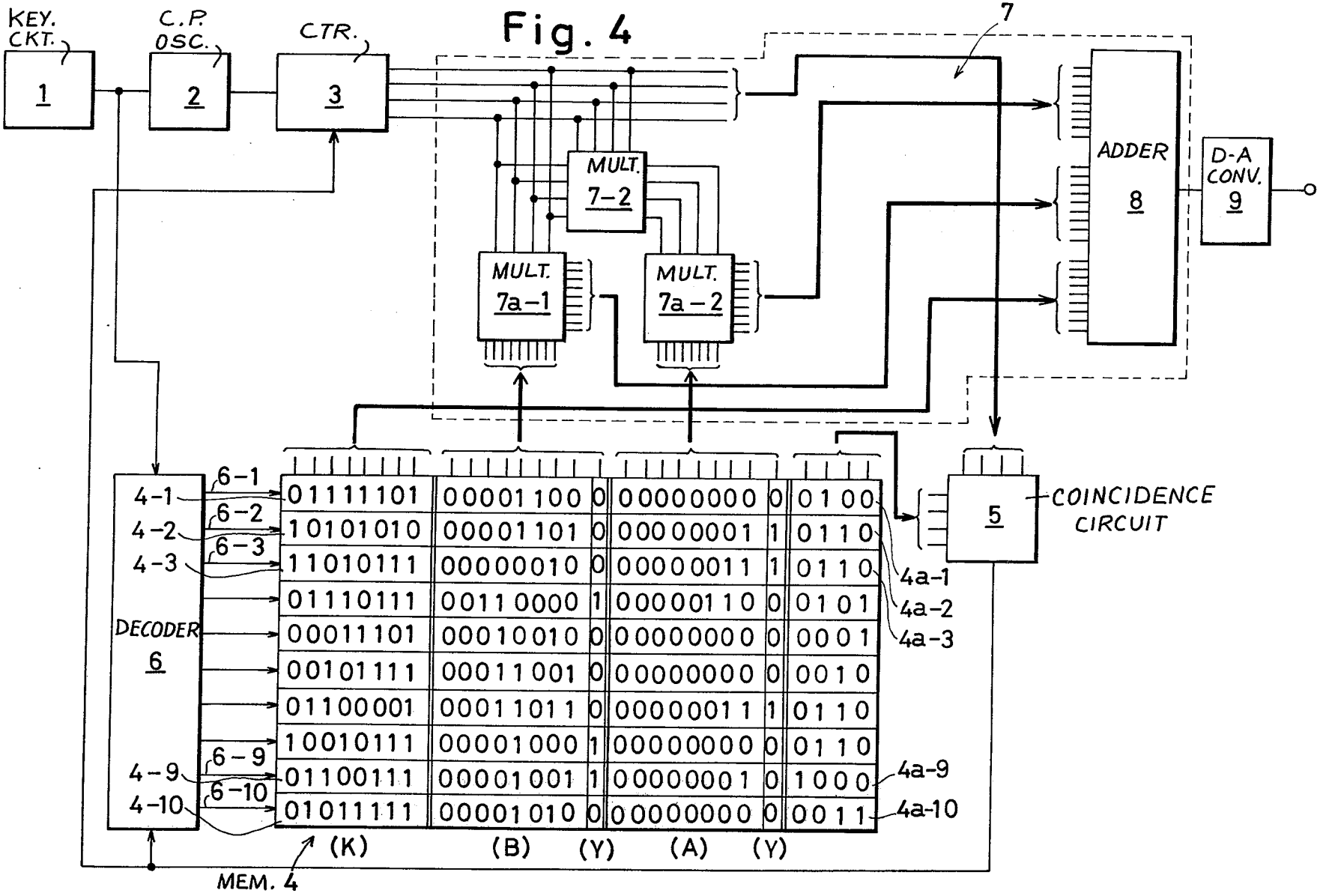
FIG. 4 is a block diagram showing one embodiment of this invention in greater detail.

In FIG. 4, the counter circuit 3 comprises four flip-flop circuits so that there may be obtained at the four associated output terminals a signal of 4 bits of the binary scale, by a counting of clock pulses, as shown in FIG. 5. Further, each address 4-1, 4-2 . . . 4-p of the memory circuit 4 is provided with portions A, B, K for memorizing the coefficients and the constants as respective musical values of 8 bits of the binary scale and also with complement memory portions Y for memorizing the positive or negative thereof in terms of 0 or 1. In accordance therewith, a 4-bits by 8-bits 2's complement multiplier is used for each of the mutually multiplying devices 7a-1 . . . 7a-p.

If the waveform in each section range in FIG. 3 is expressed by a formula into which concrete numerical values are introduced, there are established the formulae which follow below. Each section $t_1$ . . . $t_{10}$ for drawing each waveform is as shown on the right side of each formula.

| | | | | | |
|---|---|---|---|---|---|
| $f_1(t)$ = | | | 12t + 125 | $t_1 = 4$ | |
| $f_2(t)$ = | $-t^2$ | + | 13t + 173 | $t_2 = 6$ | |
| $f_3(t)$ = | $3t^2$ | + | 2t + 215 | $t_3 = 6$ | |
| $f_4(t)$ = | $6t^2$ | + | 48t + 119 | $t_4 = 5$ | |
| $f_5(t)$ = | | | 18t + 29 | $t_5 = 1$ | (II) |
| $f_6(t)$ = | | | 25t + 47 | $t_6 = 2$ | |
| $f_7(t)$ = | $3t^2$ | + | 27t + 47 | $t_7 = 6$ | |
| $f_8(t)$ = | | | −8t + 151 | $t_8 = 6$ | |
| $f_9(t)$ = | $t^2$ | | −9t + 103 | $t_9 = 8$ | |
| $f_{10}(t)$ = | | | 10t + 95 | $t_{10} = 3$ | |

Thus, the respective coefficients, the constants and the sections ranges of these formulae are memorized, as shown, in the memory circuit 4 of FIG. 4.

If, next, a key is depressed, an output signal of the keyboard circuit 1 drives the clock pulse oscillator 2 and resets the decoder 6. Upon this resetting of the decoder 6, an output signal from the first output terminal 6-1 selects the first address 4-1 and the first section range memory portion 4a-1, whereby there are taken out, in the form of a number of 8 bits of the binary scale, signals of the coefficients, the constant and the section range. The output clock pulse signal (FIG. 5(*a*)) of the clock pulse oscillator 2 is counted by the counter device 3 from which signals are taken out as 4 bits of the binary scale (FIGS. 5(*b*), (*c*), (*d*) and (*e*)). Since the signals are 0,0,0,0 at the first pulse of the clock pulses, the output of the accumulatively multiplying device 7-2 and that of the mutual multiplier 7a-1 are respectively zero. Accordingly, only the constant 125 (i.e., 0 1 1 1 1 1 0 1) is taken out through the adding circuit 8 and is converted by the D-A convertor 9 into an analog signal, whereby there is obtained a level of 125 within the section range of 0–1 on the abscissa in FIG. 6.

If, then the second of the clock pulses is applied to the counter device 3, there is taken out an output 1 (that is, 0 0 0 1 ) and this output is applied to the first mutually multiplying device 7a-1 and at the same time to the first accumulatively multiplying device 7-2. The output of the first accumulatively multiplying device 7-2 is 0 0 0 1, but the coefficient *a* is zero. Therefore, the output of the second mutually multiplying device 7a-2 is zero. Consequently, a multiplication between the constant 12 (that is, 0 0 0 0 1 1 0 0) and 1 ( that is, 0 0 0 1) is performed at the first mutually multiplying device 7a-1. Thereby, an output 12 (that is, 0 0 0 0 1 1 0 0 ) is taken out. At the same time, the constant 125 (that is, 0 1 1 1 1 1 0 1 ) is taken out, and an output 137 (that is, 1 0 0 0 1 0 0 1 ) is taken out and is then added by an addition at the adding circuit 8. The same is converted through the D-A convertor 9 into an analog signal and there is obtained a level of 137 within the section range 0–1 on the abscissa of FIG. 6.

Figure 6:
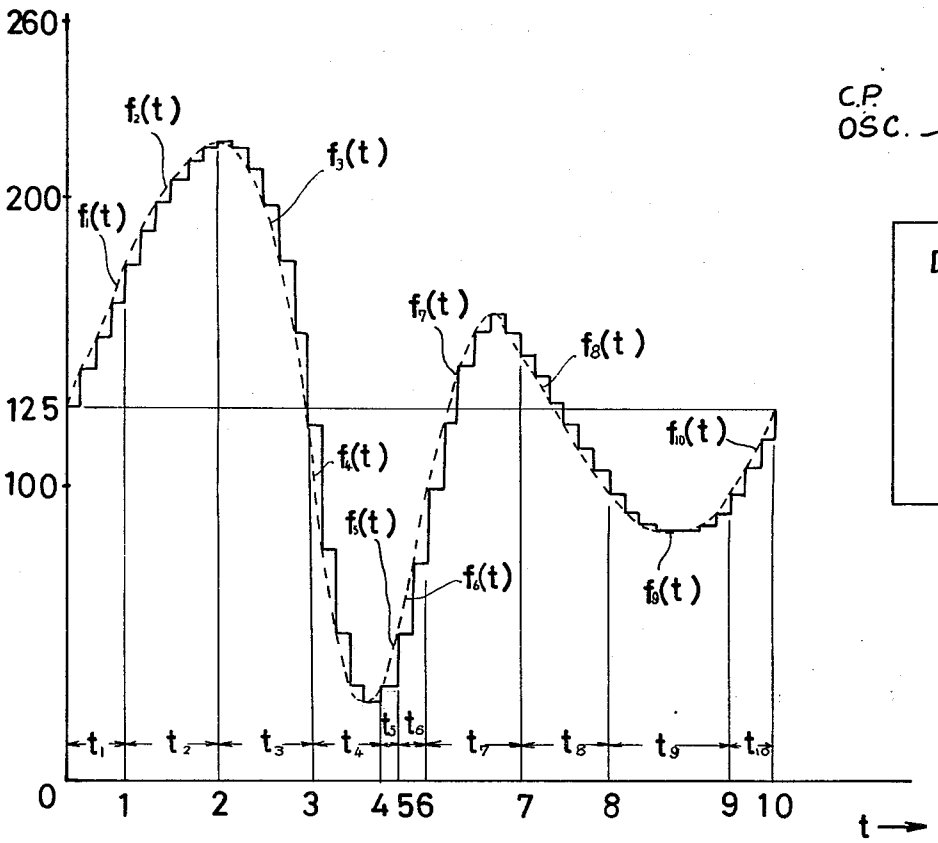
FIG. 6 is a chart showing an output waveform obtained from the embodiment of FIG. 4.

If, then, an output 2 (that is, 0 0 1 0 ) is taken out from the counter device 3, in almost the same manner as above, a multiplication thereof with the coefficient 12( that is 0 0 1 1 0 0 ) is performed and the output thereof (i.e., 24) is added to the constant 125, whereby there is obtained a level of 149 within this section range of 0–1 on the abscissa of FIG. 6.

If then, an output 3 (that is, 0 0 1 1) is taken out of the counter device 3, similarly, a multiplication thereof with the coefficient 12 (that is, 0 0 1 1 0 0 ) is performed and the constant is added thereto, whereby a level of 161 is obtained within the section range of 0–1. This is the same thing as if *t* of the formula $f_1(t) = 12t + 125$ were to be substituted by 0, 1, 2 and 3 respectively.

If then, an output 4 (that is, 0 1 0 0 ) is taken from the counter device 3, the same coincides, at the coincidence circuit 5, with an output signal 0 1 0 0 taken from the first section range memory circuit 4a-1, whereby there is generated a coincidence signal. As a result, the counter device 3 is reset and at the same time, at the decoder 6, the output signal from the first output terminal 6-1 vanishes and an output signal is taken out from the second output terminal 6-2, whereby the second address 4-2 and the second section range memory portion 4a-2 are selected.

As a result of the resetting of the counter device 3, there are taken out, in order, 0, 1, 2, 3, 4, 5 in the form of digital signals in a manner simular to that described above. Thus, a calculation whereby $t$ of the formula $f_2(t) = -t^2 + 13t, +173$ is substituted for by 0–5 in order is effected in almost the same manner as above, and there is obtained a stepped wave as shown in the section range $t_2$ in FIG. 6.

If then, an output 6 (that is, 0 1 1 0 ) is taken from the counter device 3, a coincidence signal is generated, whereby the counter device 3 is reset. At the same time, the third address 4-3 and the third section range memory portion 4a-3 are selected. Thus, the 1st to 10th addresses 4-1, . . . . 4-10 and the 1st to 10th section range memory portions 4a-1 . . . . 4a-10 are, in order, selected, so that one cycle of a musical tone waveform is drawn in the form of stepped wave as shown in FIG. 6.

On completion of this one cycle, an output is again obtained from the first output terminal 6-1 of the decoder 6 to draw one cycle of a waveform as mentioned before, and this is repeated until the key is released.

In the above case, one cycle of a musical tone waveform is drawn by forty-seven clock pulses. It is thus required that the oscillation frequency of the clock pulse oscillator 2 should be forty-seven times the frequency of the musical tone desired to be obtained.

The above embodiment has been explained to be of such a type that the oscillation frequency of the clock pulse oscillator 2 is variable so as to be a frequency corresponding to a depressed key, but it is possible that, instead, the foregoing tone source apparatus is provided individually for each key.

Figure 7:
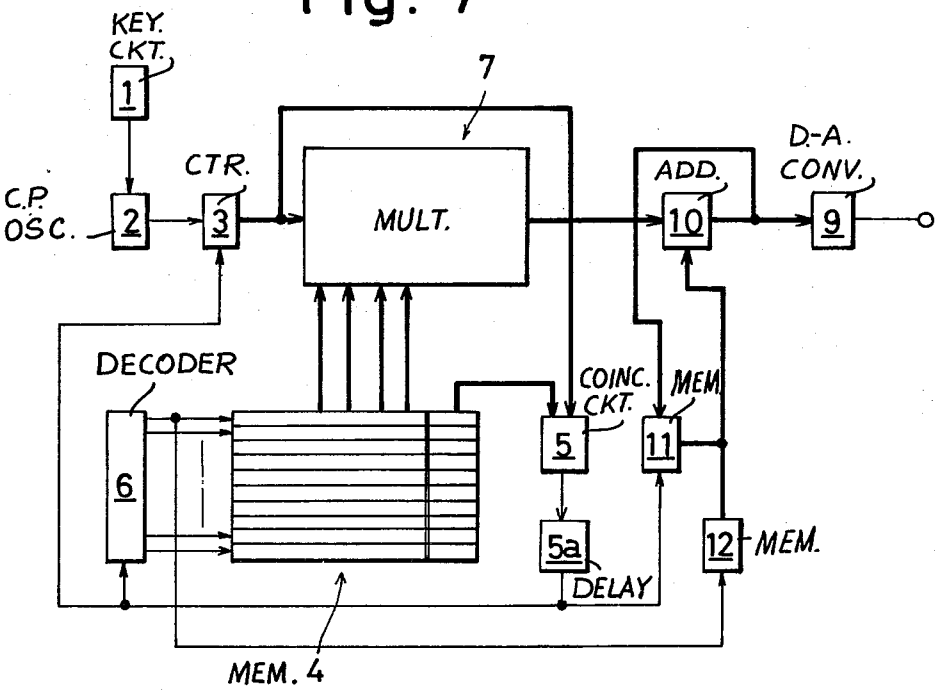
FIG. 7 is a block diagram showing another embodiment of the invention.

As will be clear from formula II in the first embodiment of the invention, every waveform formula contains, without exception, a constant. Accordingly, it is required to provide the constant memory setting portions K1 - K10. FIG. 7 shows a case where such memory portions K1 - K10 are omitted, and only a single portion K1 is used. In this case, a second adding device 10 is provided on the output side of the adding device 8. A second memory circuit 11 for memorizing the output of the second adding device 10 and a third memory circuit 12 for memorizing constant K1 are also provided. Additionally, the second memory circuit 11 is connected at its control terminal to an output terminal of the coincidence circuit 5, and the third memory circuit 12 is connected to the first input terminal of the decoder 6. Additionally, the coincidence circuit 5 is provided with a delay circuit 5a for delaying the output signal thereof.

If a key is depressed, by an output signal of the first output terminal 6-1 of the decoder 6, the first address 4-1 is selected and an output of the first address 4-1 is applied to the operational circuit 7 so that calculation, excluding the constant K1, as mentioned before, is begun. At the same time, the second memory circuit 11 is driven. Thereby, the constant $k_1$ of the waveform $f_1(t)$ (that is, 125) is applied to the second adding device 10 and is added to the output of the calculation circuit 7. Thus, the calculation of the waveform $f_1(t)$ is performed.

The calculation of the waveform $f_1(t)$ is completed by four output pulses of the clock pulse oscillator 2 (that is, the digital signals 0 0 0 0 . . . 0 0 1 1 ) of the counter device 3 as mentioned before. However, in this embodiment, the delay circuit 5a is provided on the output side of the coincidence circuit 5, so that the selection of the second address is delayed. During this delayed period, an output 0 1 0 0 is taken out following the 0 0 1 1 from the counter device 3. This output 0 1 0 0 and an output of the first address 4-1 are calculated and the constant $k_1$ is added thereto, whereby the constant $k_2$ is obtained as an output of the second adding device 10. If a coincidence signal is generated after the lapse of the delayed period, the second address 4-2 is selected. At the same time, the constant $k_2$ is memorized in the second memory circuit 11. Then, similarly, the constant $k_2$ is taken from the second memory circuit 11 for calculation of the waveform $f_2(t)$. Thus, the respective constants of the waveforms $f_1(t)$ . . . $f_{10}(t)$ can be taken out in order so that a waveform as shown in FIG. 6 can be created.

In the embodiment of FIG. 4, the calculation circuit 7 is arranged to make a calculation of a waveform formula with two coefficients, so that it is sufficient with using three digital multiplying devices 7-2, 7a-1, 7a-2. As the number of coefficients is increased, the number of multiplying devices is increased, as shown in FIG. 2, so that the circuit is complicated and high priced.

Figure 8:
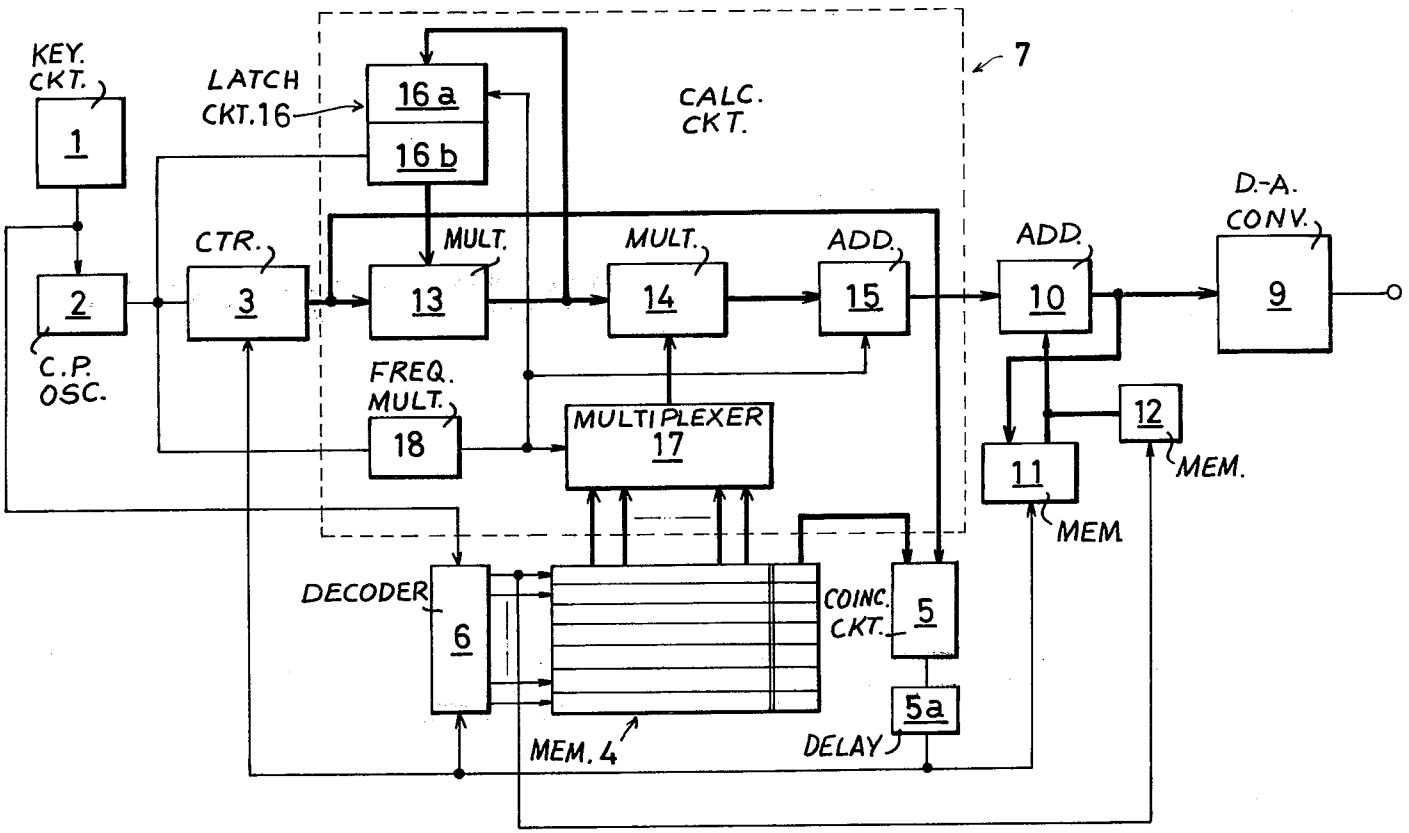
FIG. 8 is a block diagram showing a third embodiment of the invention.

FIG. 8 shows a case where the calculation circuit 7 is simplified. In this case, the construction is made uniform regardless of number of the coefficients.

Components 13 and 14 are digital multiplying devices connected in series to an output terminal of the counter device 3. Component 15 is a digital adding device connected to an output terminal of the rear stage digital multiplying device 14. An output terminal thereof is connected to the D-A convertor 9 through the second adding device 10 in FIG. 7. An output terminal of the front stage digital multiplying device 13 is connected through a latch circuit 16 to another input terminal of the same digital multiplying device 13.

Component 17 is a multiplexer having input terminals comprising output terminals of the memory circuit 4. Component 18 is a frequency multiplying circuit for multiplying by $n$ times the output pulses of the clock pulse oscillator 2. The output terminal thereof is connected to the latch circuit 16, the digital adding device 15 and a control terminal of the multiplexer 17.

The constant $k_1$ of the first waveform $f_1(t)$ is memorized in the third memory circuit 12 in almost the same manner as in the embodiment in FIG. 7. The remainder constants K2-K10 are so arranged that ones obtained from calculations of the respective preceding stage formulae are memorized in the second memory circuit 11 so as to be taken out in order therefrom. The latch circuit 16 comprises a first memory portion 16a, which memorizes an output of the front stage digital multiplying device 13 and a second memory circuit 16b which memorizes 1 (that is, 0 0 0 1).

The second memory portion 16b operates in such a manner that the same is driven by an output of the clock pulse oscillator 2 so as to produce an output 0 0 0 1 and the output is stopped by a second pulse of the frequency multiplying device, 18. The first memory portion 16a operates in a manner such that, after completion of the output 0 0 0 1 of the second memory portion 16b, the same is controlled by the second and the subsequent pulse of the frequency multiplying circuit 18, for memorizing and taking an output from the digital multiplying device 13.

If clock pulses are generated by the clock pulse oscillator 2 by depression of a key, the second memory portion 16*b*, the counter device 3 and the frequency multiplying circuit 18 are operated by a first pulse thereof. The output 0 0 0 1 is taken from the second memory portion 16*b*, and an output 0 0 0 0 is taken from the counter device 3. These outputs are multiplied at the digital multiplying circuit 13 to provide an output 0 0 0 0 . This is memorized in the first memory portion 16*a*. A second pulse taken from the frequency multiplying circuit 18 triggers the first memory portion 16*a* to produce an output 0 0 0 0 and at the same time to memorize the output of the digital multiplying device 13. The digital multiplying device 13 makes calculations of $0^1$, $0^2$, $0^3$, $0^4$ . . . Meanwhile, output pulses of the frequency multiplying circuit 18 are in order applied to the multiplexer 17, whereby the coefficients memorized in the first address 4-1 are in order taken out from the lower order ones and the same are in order multiplied by the outputs of the digital multiplying device 13. Thus, the outputs of the digital multiplying device 13 are kept at 0 0 0 0 as mentioned before, so that the outputs of the digital adding device 15 are zero. Accordingly, the constant $k_1$ is taken out from the third memory circuit 12 and by a first of the clock pulses a level of the constant $k_1$ is obtained. If the, a second pulse of the clock pulses is generated, the output of the second memory portion 16*b* is 0 0 0 1 and a multiplication thereof by output 0 0 0 1 from the counter device 3 is effected at the digital multiplying device 13 and there is obtained an output 0 0 0 1.

As mentioned before, this output is multiplied repeatedly through the first memory operation 16*a* by being controlled by output pulses of the frequency multiplying circuit 18, whereby calculations of $1^1$, $1^2$, $1^3$, . . . are made in order. These outputs are in order multiplied by outputs obtained from the multiplexer 17 and are accumulatively calculated and are taken out as outputs while being added to the constant $k_1$ at the second adding device 10.

If a third of the clock pulses generated by oscillator 2 is generated, the output of the counter device 3 becomes 0 0 1 0 and is multiplied by output 0 0 0 1 of the second memory portion 16*b*. Thus, the output of the digital multiplying device 13 becomes 0 0 1 0 and is memorized in the first memory portions 16*a*. By a second pulse from the circuit 18, this memorized signal is taken out and the output of the digital multiplying device 13 becomes 0 1 0 0 . Similarly, this is memorized and an output 1 0 0 0 is taken by a third pulse. Thus, digital signal outputs of $2^1$, $2^2$, $2^3$ . . . $2^n$ can be obtained in order. Next, similarly, digital signals $3^n$, $4^n$ . . . can be obtained respectively by a fourth pulse, a fifth pulse . . . and so on, of the clock pulse oscillator 2. Thus, digital signal outputs obtained in order at the output terminal of the digital multiplying device 13 are multiplied in order by the coefficients at the digital multiplying device 14 so as to be in order taken out as outputs. This is similarly carried out in order in respect of the first to tenth addresses 4-1 . . . 4-10. Thus, one cycle of the waveform is created.

In the above embodiment, a waveform in each section range is expressed by a *n* degree multiple term formula, but the same can be expressed by using a trigonometrical function, a logarithmic function, an exponential function or the like. In this case, the calculation circuit is required to be modified in accordance with the respective function used, but such a modification can be easily carried out based on the foregoing embodiments.

According to this invention, any desired complicated musical tone waveform can be obtained and a musical tone faithful to a natural musical instrument tone can be obtained. Further, a special musical tone which has not been realized so far can be also obtained at will. Additionally, an apparatus can be easily provided in the form of an integrated circuit because of use of digital signals.

What is Claimed is:

1. A tone source apparatus for an electronic musical instrument, said apparatus comprising a memory circuit which has a plurality of addresses so that, where at least one cycle of a musical tone waveform is divided into p units and a waveform in each section range is repeated by a formula containing the abscissa as its variable, a coefficient and a section range quantum number of each such formula are memorized as digital signals in a corresponding address, said apparatus further comprising a clock pulse oscillator, a counter means coupled to and counting output clock pulses of the clock pulse oscillator, said counter means producing a digital output signal, a coincidence circuit generating a coincidence signal when the digital output signal of the counter means and a digital signal of the section range quantum number memorized in the memory circuit coincide with one another, decoder means designating the next stage address in order in response to output signal of the coincidence circuit, a calculation circuit for calculating a digital output signal from a digital signal from the counter means and a coefficient digital signal from the designated address, and D-A convertor means for converting the digital output signal of the calculation circuit into a corresponding analog signal.

2. A tone source apparatus as claimed in claim 1, wherein the plurality of addresses in the memory circuit comprises a plurality of memory portions in which are memorized, as digital signals, respective coefficients of *n* degree multiple term formulae for respective section ranges, and respective section range quantum numbers.

3. Apparatus as claimed in claim 2, wherein the calculation circuit comprises accumulatively multiplying means for accumulatively multiplying digital output signals from the counter means, a plurality of mutually multiplying means for multiplying digital output signals of the accumlatively multiplying means and coefficient digital signals from respective memory portions of the addresses, and an adding means for adding outputs of said mutually multiplying means.

4. Apparatus as claimed in claim 3, wherein each address in the memory circuit is provided with a constant memory portion for a constant in each multiple term formula for each section range, the constant signal from the constant memory portion, on selection of each address, being applied to the adding means.

5. Apparatus as claimed in claim 3 wherein said decoder means includes a plurality of output terminals, said apparatus further comprising a second memory circuit connected to a first output terminal of the decoder means and adapted to memorize the constant of the first section range waveform, a second adding means on the output side of the first said adding means, a third memory circuit which memorizes an output signal from said second adding means, and a delay circuit for delaying an output of the coincidence signal from the coincidence circuit, such that a constant signal is taken from the second memory circuit by the action of an output signal from the said first output terminal and thereafter, at each time of generation of the coincidence signal by the delayed coincidence signal, an output of the second adding means is memorized as a constant of each section range waveform formula in the third memory circuit, for being applied as an input to the second adding means.

6. Apparatus as claimed in claim 5 comprising and wherein the plurality of output terminals of the counter means are connected with front and rear stage digital multiplying means and an adding means connected in series with one another, said apparatus further comprising a latch circuit, a multiplexer, and a frequency multiplying circuit having an output terminal, the front stage digital multiplying means having an output connected through said latch circuit to input terminals of the front stage multiplying means, input terminals of the rear stage multiplying means being connected through said multiplexer to the third memory circuit, said foregoing latch circuit and said multiplexer being connected to the output terminal of said frequency multiplying circuit for frequency-multiplying an output pulse generated by the clock pulse oscillator, said latch circuit comprising a first memory portion which is controlled by the output pulse of the frequency multiplying circuit so as to memorize and send out an input signal and a second memory portion which memorizes a digital signal of "1", the second memory portion sending out the digital signal "1" in response to a first pulse of the frequency multiplying circuit.

* * * * *

UNITED STATES PATENT AND TRADEMARK OFFICE

CERTIFICATE OF CORRECTION

PATENT NO. : 4,023,454

DATED : May 17, 1977

INVENTOR(S) : Obayashi et al

It is certified that error appears in the above-identified patent and that said Letters Patent are hereby corrected as shown below:

Change assignee from Kabushiki Kaisha Dawai Gakki Seisakusho to --Kabushiki Kaisha Kawai Gakki Seisakusho--

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*